United States Patent [19]

Davenport

[11] Patent Number: 4,696,601

[45] Date of Patent: Sep. 29, 1987

[54] ARTICULATED COMPLIANT OFFSHORE STRUCTURE

[75] Inventor: George F. Davenport, Houston, Tex.

[73] Assignee: Exxon Production Research Company, Houston, Tex.

[21] Appl. No.: 885,358

[22] Filed: Jul. 14, 1986

[51] Int. Cl.[4] ..... E02B 17/00

[52] U.S. Cl. ..... 405/202; 405/203; 405/224

[58] Field of Search ..... 405/202, 224, 227, 195, 405/203, 205, 207

[56] References Cited

U.S. PATENT DOCUMENTS

| | | | |
|---|---|---|---|
| 3,522,709 | 8/1970 | Vilain | 405/202 |
| 3,524,323 | 8/1970 | Miller | 405/202 |
| 3,636,716 | 1/1972 | Castellanos | 61/46.5 |
| 3,670,515 | 6/1972 | Lloyd | 61/46.5 |
| 4,069,682 | 1/1978 | Taylor et al. | 405/202 |
| 4,175,890 | 11/1979 | Taylor | 405/202 |
| 4,234,270 | 11/1980 | Gjerde et al. | 405/202 |
| 4,284,367 | 8/1981 | Tuson et al. | 405/202 |
| 4,432,668 | 2/1984 | Rank | 405/202 |

FOREIGN PATENT DOCUMENTS

| | | |
|---|---|---|
| 2066336 B | 7/1981 | United Kingdom . |
| 2070112 A | 9/1981 | United Kingdom . |
| 2123883 A | 2/1984 | United Kingdom . |

OTHER PUBLICATIONS

Article, "Exxon Study Shows Compliant Pile Tower Cost Benefits", Maus, L. D. et al., Ocean Industry, Mar. 1986, pp. 20–25.

Article, "Compliant Jacket Challenges Deep Water with New Design", McFillivray, T. L. et al., Oil & Gas Journal, May 6, 1985, pp. 112–115.

*Primary Examiner*—David H. Corbin

*Attorney, Agent, or Firm*—Richard F. Phillips

[57] ABSTRACT

An articulated, compliant offshore structure having a base portion establishing a gravity-type foundation on the ocean bottom, a tower extending upward from the base portion and a deck seated on the tower a spaced distance above the ocean surface. The tower is secured to the base portion by an articulated joint which permits the tower and deck to undergo limited pivoting about the base. This provides compliancy in response to forces imposed on the structure by wind, waves and ocean currents. A set of tensioned members, preferably cables, are secured between anchorages on the base and at an elevated position on the tower to provide controlled resistance to pivoting of the tower. In the preferred embodiment the tower and base are concrete shell structures.

30 Claims, 12 Drawing Figures

ARTICULATED COMPLIANT OFFSHORE STRUCTURE

FIELD OF THE INVENTION

The present invention generally concerns offshore structures adapted to have a compliant response to forces imposed by waves, wind, and ocean currents. More specifically, the present invention concerns a compliant offshore hydrocarbon drilling and production platform having a compliant tower secured to a rigid base by an articulated joint.

BACKGROUND OF THE INVENTION

Most offshore oil and gas production is conducted from structures (commonly termed "platforms") supported on the seafloor and extending upward to a drilling and production deck situated above the ocean surface. A key constraint in the design of such platforms is that dynamic amplification of the platform's response to waves must be avoided. Failure to substantially avoid dynamic amplification will result in a reduction of the fatigue life of the platform and in extreme cases can result in failure of key structural platform components. Dynamic amplification of the platform's response is avoided by designing the platform such that each of its natural vibrational periods fall outside that range of wave periods representing waves of significant energy. For most offshore locations the range of natural vibrational periods to be avoided is from 7 to 25 seconds, this representing the range of wave periods occurring with the greatest frequency. The several modes of platform vibration which are generally of greatest concern in platform design are pivoting (commonly termed "sway") of the structure about a joint, flexure ("bending") of the structure along its height, and torsion about the structure's vertical axis.

For water depths up to about 300 meters, the technology for avoiding dynamic amplification of an offshore structure's wave response is well developed. Nearly all existing offshore structures used in such water depths are rigidly secured to the ocean bottom and stiffened to cause the various natural vibrational periods of the structure to be less than about 7 seconds. Such offshore structures are referred to as "rigid structures." The most common rigid structure used in offshore oil production is a tubular steel space-frame secured to the ocean floor by a pile-type foundation. An alternate rigid structure, employed most extensively in the North Sea, is the concrete gravity structure. Concrete gravity structures include a caisson which rests on the ocean floor. One or more towers are rigidly secured to the caisson and extend upward to a drilling and production deck above the ocean surface. Foundation skirts extend downward from the caisson to transmit lateral environmental loads into the ocean floor. The caisson and skirts act under the submerged weight of the structure to establish a gravity foundation rigidly supporting the tower on the ocean floor.

As water depths exceed 300 meters, the volume of structural material required to maintain sufficient platform stiffness to retain the natural vibrational periods of a rigid structure below 7 seconds increases rapidly with depth. As a result, the cost of rigid structures becomes increasingly depth sensitive in water depths beyond 300 meters. It has been suggested that for even the richest offshore oil fields the use of a rigid structure could not be economically justified in water depths exceeding about 420 meters due to the constraint imposed by the maximum permissible natural vibrational period.

For deep water applications, it has been proposed to depart from conventional rigid structure design and develop platforms having a fundamental period greater than the range of periods of ocean waves containing significant energy. Such platforms, termed "compliant structures," do not rigidly resist waves and other environmental forces, but instead compliantly resist environmental loads primarily by their own inertia, undergoing significant lateral motion at the ocean surface. The mode shape associated with the fundamental period of a compliant structure is typically achieved either by pivoting of the structure about a joint or by bending over some length in the structural system itself. It is normally impractical to render the periods of second and higher modes compliant, requiring that these periods be kept below about 7 seconds to prevent dynamic amplification of the higher modes. Thus, compliant structures are characterized by the fact that the range of ocean-wave periods containing significant energy is straddled by the fundamental period on the high side (above about 30 seconds), and by all remaining periods on the low side (below about 7 seconds). The use of a compliant offshore structure effectively removes the upper bound on the fundamental period, thus avoiding the most troublesome design contraint of rigid structures. This greatly reduces the increase in the volume of structural material, and hence cost, required for a given increase in water depth.

Compliant structures must be provided with some mechanism for countering lateral displacement resulting from the action of wind, waves and currents. Countering such lateral displacement is termed "stabilization." Stabilization is accomplished in existing compliant offshore structures in a variety of manners. In one class of compliant offshore structures, including tension leg platforms and buoyant towers, stabilization is provided by buoyancy. Such structures include a buoyant portion typically located either at the ocean surface or just below the wave zone. As environmental forces displace the platform from a vertical orientation, the buoyant force acting on the buoyant portion establishes a righting moment which acts to restore the structure to a vertical orientation. A significant disadvantage of buoyant structures is that the large buoyancy chambers they require greatly increase the expense of the structure. Additionally, these buoyancy chambers must be located at or near the ocean surface, increasing the cross-sectional area of the structure exposed to environmental forces. This results in increased loading, requiring a stronger structure than would otherwise be necessary. A typical tension leg platform is shown in U.S. Pat. No. 4,428,702, issued Jan. 31, 1984. A typical buoyant tower is shown in U.K. Pat. No. 2,066,336B, issued Nov. 2, 1983.

In a second type of compliant structure, the guyed tower, the platform deck is supported on a slender space-frame structure extending from the ocean bottom to the ocean surface. A plurality of catenary guylines extend radially outward from an upper portion of the space-frame structure to the ocean bottom. The guylines provide the necessary stabilization. A major disadvantage of guyed towers is that the guyline system is expensive to fabricate, deploy and maintain. In certain applications the guylines also present an obstacle to navigation and fishing in the vicinity of the platform. A typical guyed tower is detailed in U.S. Pat. No. Re. 32,119, issued Apr. 22, 1986.

A third type of compliant structure, known as the compliant piled tower, uses flex plies to provide stability. The compliant piled tower is a rigid tower structure having piles extending upward along its periphery to a preselected elevation where the piles are grouted or otherwise rigidly secured to the tower. The tower is supported laterally at its lower end by the flex piles, but is permitted to slide vertically along the flex piles and rotate about its lower end. In response to movement of the tower away from the vertical, the piles establish a righting moment (couple) acting at the point of pile attachment. This provides the stabilization necessary to restore the tower to a vertical orientation. A disadvantage of the compliant piled tower is that design and installation are complicated by conflicting demands placed on the flex piles, which must be flexible enough to achieve compliant behavior, yet stiff enough to withstand pile-driving stresses during installation. Another disadvantage of the compliant piled tower is that a portion of each flex pile must be driven after the tower is in place. This is expensive and extends the duration of the required installation window when the structure is vulnerable to damage by storms. One form of compliant piled tower is detailed in U.S. patent application Ser. No. 806,055, filed Dec. 5, 1985.

It would be desirable to develop a compliant offshore platform which does not rely on positive buoyancy, guylines or fixed piles to counter the lateral forces imposed by wind, waves, and ocean currents.

SUMMARY OF THE INVENTION

The present invention is directed to a compliant offshore structure in which a tower is secured to a rigid base by an articulated joint, permitting the tower to pivot about the base in response to wind, waves and ocean currents. The base preferably comprises a gravity foundation, but alternately may be piled to the ocean floor. A plurality of tension members, preferably consisting either of prestressed cables or slender steel columns, are secured between an anchorage in the base and an anchorage located on the tower at a preselected distance above the base. The tension members are arranged so that as the tower pivots the tension members on that side of the tower away from the direction of tilting are placed in increased tension while the tension members on the opposite side of the tower are placed in reduced tension. This establishes a restoring couple stabilizing the tower against excessive sway. The number, location and material properties of the tension members are selected to provide the structure with a sway period exceeding about 25 seconds and preferably in the range of 35 to 40 seconds. This is sufficiently great to ensure that there is substantially no dynamic amplification of the platform's response to waves.

Numerous advantages are achieved by the manner in which compliancy and tower stabilization are achieved in the present invention. In a preferred embodiment, the tower is a concrete shell structure and the tension members are prestressed cables serving not only to provide the necessary stabilization against waves and other environmental forces, but also to maintain that portion of the tower beneath the tower cable anchorage in compression, avoiding the need for conventional bonded prestressing steel in the concrete. Also, by prestressing the tension members against the lower portion of the tower, permanent buoyancy is not required to maintain tension in the cables. Further, by placing the tower cable anchorage below the wave zone, the cross sectional area of the structure exposed to waves and currents is significantly smaller than that achievable with other forms of compliant offshore structures, such as tension leg platforms, buoyant towers and guyed towers. Additionally, the tension members may be installed and fully tensioned prior to platform installation offshore, yielding a more straightforward and less expensive installation procedure than is the case with other types of compliant offshore structures, which typically require offshore installation of tethers, cables, guylines or piles.

BRIEF DESCRIPTION OF THE DRAWINGS

For a better understanding of the present invention, reference may be made to the accompanying drawings, in which.

In certain of the drawings the number of cables and related components has been reduced in the interest of clarity. These drawings are not intended as a definition of the invention, but are provided solely for the purpose of illustrating certain preferred embodiments of the invention, as described below.

DESCRIPTION OF THE PREFERRED EMBODIMENTS

Figure 1:
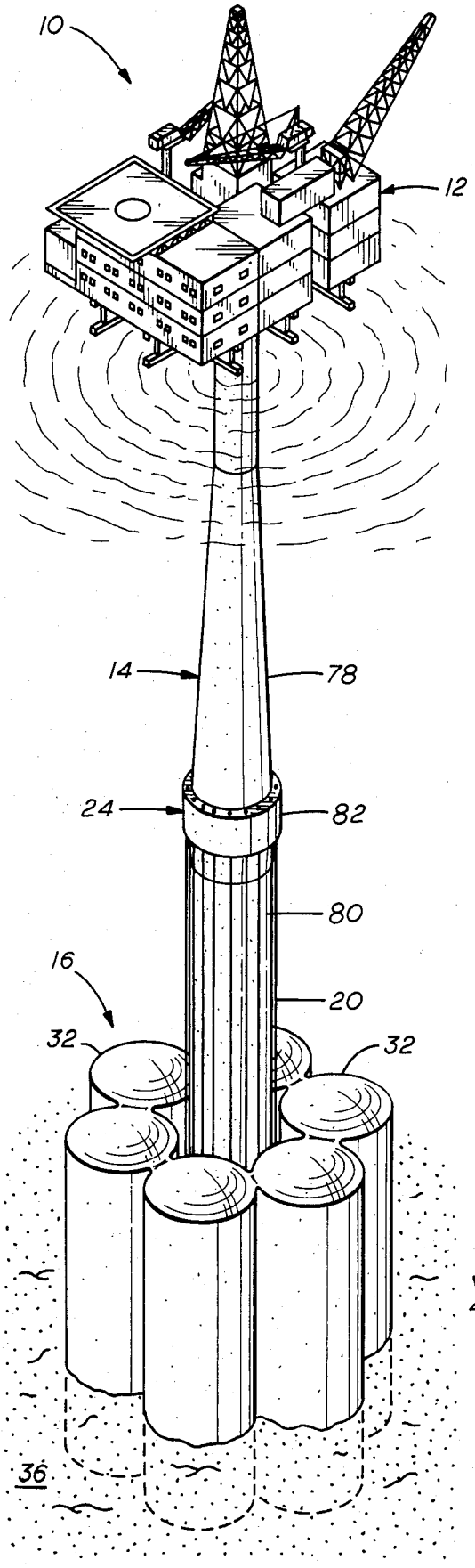
FIG. 1 is an isometric view of an articulated, compliant offshore structure incorporating a preferred embodiment of the present invention.

FIG. 1 shows an elevational view of an articulated, compliant offshore structure 10 incorporating a preferred embodiment of the present invention. As will become apparent in view of the following description, the preferred embodiment of the structure 10 is adapted for use as an oil and gas drilling and production platform for placement in water depths exceeding about 300 meters. However, the present invention can assume many other embodiments and can be used for a variety of other purposes. To the extent that the following description details a specific embodiment of an offshore drilling and production platform, this is by way of illustration rather than limitation.

As shown in FIG. 1, the articulated, compliant offshore structure 10 includes a drilling and production deck 12 rigidly secured atop a tower 14. The tower 14 is supported by a base portion 16 which in the preferred embodiment establishes a gravity-type foundation for the structure 10. In the preferred embodiment, reinforced, prestressed concrete shell construction is used for both the tower 14 and base 16. However, steel space frame structures could be used instead. The tower 14 is connected to the base 16 by an articulated joint 18 (FIG. 2) which permits the tower 14 to sway about the base 16, rendering the structure 10 compliant in response to forces imposed by wind, waves and ocean currents. As detailed more fully below, in the preferred embodiment the articulated joint 18 incorporates an elastomeric hinge interposed between mating hemispherical bearing surfaces. However, it should be understood that the nature of the articulated joint 18 is not critical to the structure 10 and that many other types of articulated joints could be used in place of that described below. For example, in an embodiment of the structure 10 in which the base and tower are steel space frame structures, the joint 18 could take the form of a flex bay as taught in copending U.S. patent application Ser. No. 756,405, filed July 17, 1985.

Stability is provided by stabilizing members 20, preferably prestressed cables, extending from a lower tension member anchorage 22 in the base 16 to an upper tension member anchorage 24 located on the tower 14. As the structure 10 tilts away from the vertical, those cables 20 away from the direction of tilt are placed in increased tension while those cables 20 toward the direction of tilt are placed in reduced tension. This establishes a righting couple tending to restore the structure 10 to a vertical orientation. Because the cables 20 are structurally prestressed between the upper tension member anchorage 24 and the base 16 it is not necessary to provide the platform with any supplemental buoyancy. The cables provide the structure with the full measure of stabilization required to overcome environmental forces.

In the preferred embodiment of the present invention, the use of a compliant tower 14 in conjunction with a gravity base 16 renders the dynamic response of the tower 14 substantially insensitive to foundation stiffness. The combination of a flexible element (the articulated tower 14) in series with a rigid element (the gravity base 16) results in the combined vibrational characteristics of the system being substantially insensitive to the vibrational characteristics of the rigid element. This is highly advantageous relative to conventional rigid gravity structures, which have strong dynamic coupling between the tower and the foundation and accordingly have a dynamic response controlled in large part by foundation stiffness. The advantage of the present compliant structure relative to conventional gravity structures is best illustrated by the relationship $$T_1 = \sqrt{T_{11}^2 + T_{22}^2},$$

which states that the natural vibrational period, $T_1$, of a two degree-of-freedom system is approximately equal to the square root of the sum of the squares of the component natural vibrational periods, $T_{11}$ and $T_{22}$, of the two elements of the system. Because the properties of the seabed on which a platform is to be placed typically cannot be accurately determined, there is often significant uncertainty in the natural vibrational period of the platform base. In conventional rigid gravity structures this uncertainty forces a very conservative (i.e. very rigid) tower and base design to ensure that the natural vibration period of the combined structure is less than about 7 seconds. However, in the articulated, compliant offshore structure of the present invention, uncertainty in the soil properties has substantially no effect on the period of the structure. This is because the period of the rigid base, typically less than about 4 seconds, is small relative to the period of the tower, typically 35 seconds. Changes in the foundation period of ±100% alter the period of the combined structure by less than one second. Thus, the present invention avoids the need for excessively conservative foundation design. In addition to the dynamic response of offshore structures incorporating the present invention being relatively insensitive to foundation stiffness, compliant structures have relatively low foundation loads, rendering them more applicable to soft-soil conditions than rigid gravity structures. Compliant structures are also less sensitive to earthquakes than conventional rigid structures.

Figure 2:
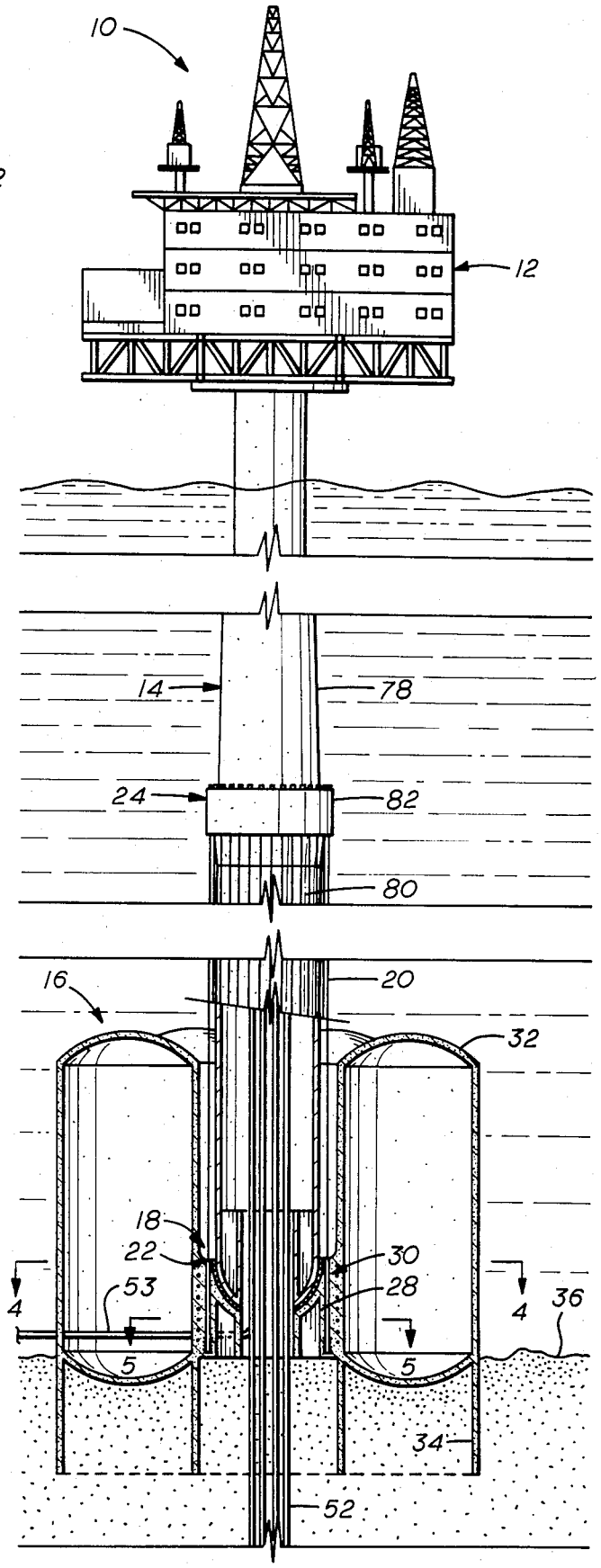
FIG. 2 is an elevational view partly in section of details of the offshore structure shown in FIG. 1.

In the preferred embodiment, the base 16 of the structure 10 establishes a gravity foundation. As best shown in FIG. 2, the base 16 includes a central caisson cell 28 which forms a housing 30 for the articulated joint 18 and also contains the base tension member anchorage 22. A plurality of outer caisson cells 32 are secured in a concentric array about the central caisson cell 28. Skirts 34 extend downward from the outer caisson cells 32 to competent soils beneath the seafloor 36. The base 16 supports the submerged weight of the structure 10 and resists the lateral loadings transferred through the articulated joint 18 and the cables 20. The outer caisson cells 32 are adapted to be selectively flooded with seawater during construction, transportation and installation of the structure 10 to control floating stability. The outer caisson cells 32 are totally flooded at the time of structure installation to increase the weight of the structure 10, forcing the skirts 34 into the seafloor 35. Hydrostatic pressure may also be used to facilitate penetration of the skirts 34. After oil production has commenced, the outer caisson cells 32 may be used for crude oil storage. An oil storage riser (not shown) extending between the outer caisson cells 32 and the deck 12 is provided for transferring the crude oil to and from the caisson cells 32. Though the preferred embodiment of the structure 10 utilizes a gravity foundation, a pile-type foundation could be substituted without departing from the present invention.

Figure 3:
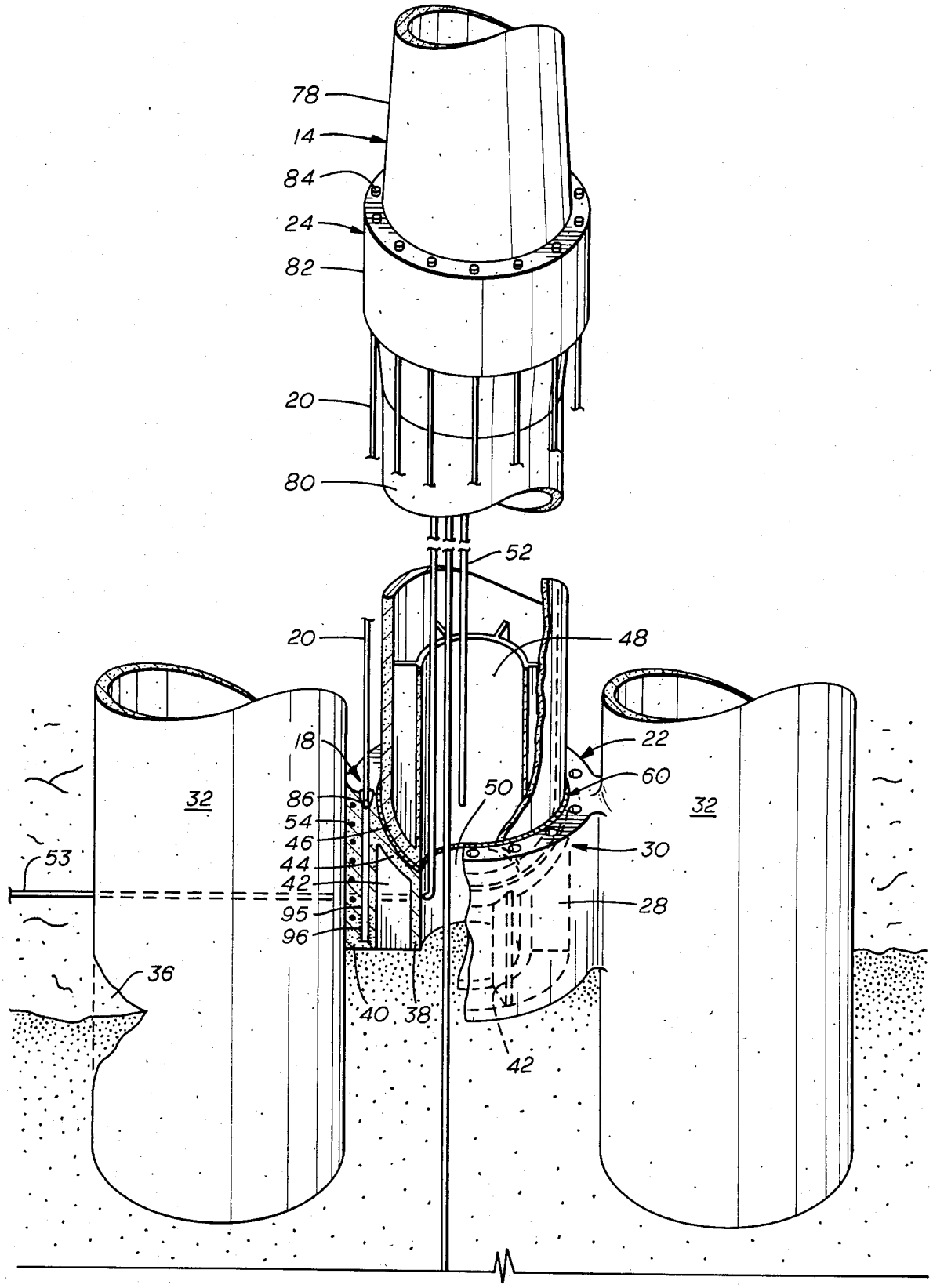
FIG. 3 is an isometric, break-away view of the base portion, articulated joint and ring beam of the offshore structure shown in FIGS. 1 and 2.
Figure 4:
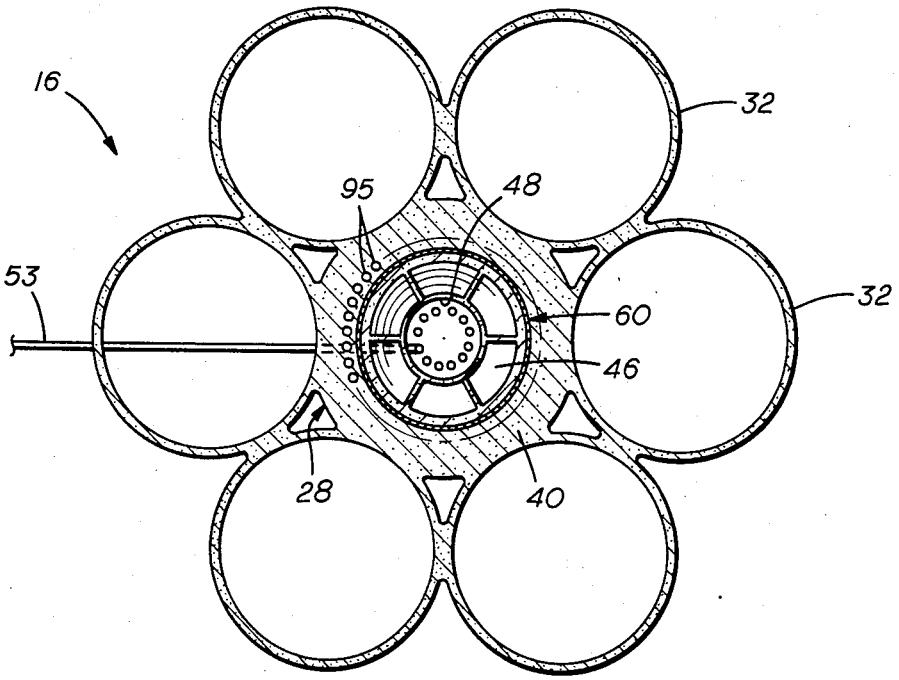
FIG. 4 is a cross-section taken in plan view along line 4—4 of FIG. 2.
Figure 5:
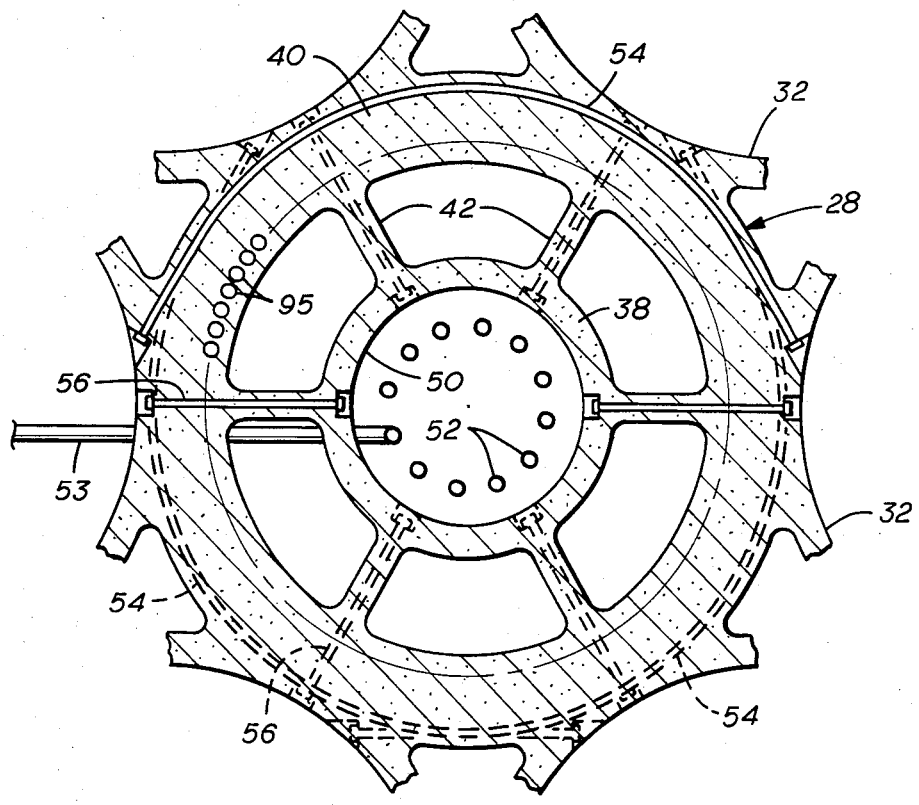
FIG. 5 is a cross-section taken in plan view along line 5—5 of FIG. 2.

As best shown in FIGS. 3–5, the joint housing 30 includes inner and outer housing ringwalls 38,40 connected by a plurality of radial diaphragms 42. The upper end portions of the ringwalls 38,40 and radial diaphragms 42 support a concave-upward hemispherical tower support shell 44. The lowermost portion of the tower 14 defines a mating convex hemispherical lower tower shell 46. As will be described in greater detail below, the lower tower shell 46 is pivotably supported on the tower support shell 44 of the base 16 to establish the articulated joint 18. Though the preferred embodiment of the joint 18 defines a concave upward hemispherical bearing surface having a diameter equal to that of the lower end of the tower 14, the joint 18 could alternately be concave downward and have a radius of curvature which differs from the radius of the lower end of the tower 14. The tower 14 and the joint housing 30 are provided with aligned vertical recesses 48,50 surrounding the central axis of the structure 10 to allow access for drilling conductors 52, an import-export riser 53, a storage riser, j-tubes, ballast water piping and related components.

The joint housing 30 is maintained in triaxial compression. This ensures that the concrete in this portion of the structure 10 is protected from cracking. Axial compression is established by the downward loading of the tower 14 acting at the tower support shell 44 and the upward loading imposed by the cables 20 acting through the cable anchorage embedments, the outer caisson cells 32 acting at the outer housing ringwall 40, and the resistance of the seafloor 36 acting on the bottom of the joint housing 30. As best shown in FIG. 5, circumferential prestressing is established by adjustable circumferential prestressing members 54 extending along the circumference of the outer housing ringwall 40. Radial prestressing is established by prestressing members 56 extending radially through each of the radial diaphragms 42.

Figure 8:
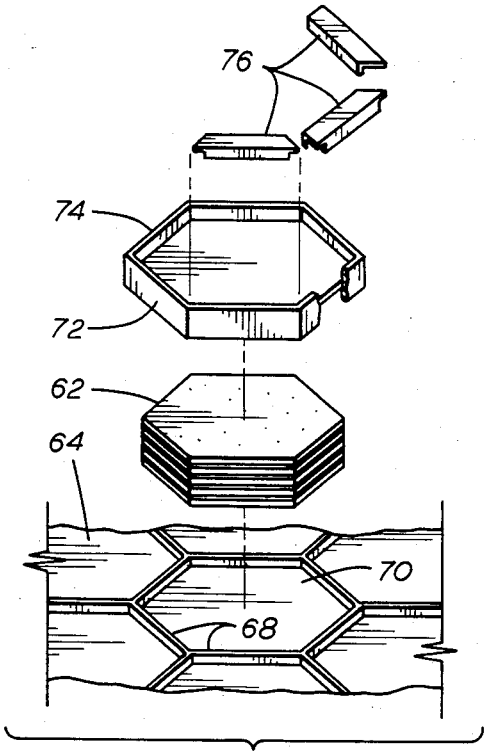
FIG. 8 is an exploded isometric view showing the arrangement of one of the hexagonal elastomeric pads and related components of the articulated joint.

In the preferred embodiment, a layer of elastomeric material 60 is interposed between the tower support shell 44 and the lower tower shell 46. This layer of elastomeric material 60 serves as a hinge, accommodating all relative movement in the articulated joint 18. As best shown in FIG. 8, the elastomeric layer 60 includes a plurality of hexagonal elastomeric pads 62 which in the preferred embodiment cover substantially the entire surface between the mating tower support shell 44 and the lower tower shell 46. The elastomeric pads 62 are supported on their lower (radially outermost) surface by a steel joint liner 64 which is secured to the concrete tower support shell 44 by anchor studs 66. The joint liner 64 is provided with an array of steel retainer ribs 68 on its upper surface defining a grid of hexagonal pockets 70 into which the elastomeric pads 62 are received. An upper retainer cap 72 cast into the concrete lower tower shell 46 rests atop each of the elastomeric pads 62. As described in greater detail below, the upper retainer caps 72 collectively provide the lower formwork for casting the lower tower shell 46.

The full submerged weight of the tower 14 and the reaction load of the prestressed cables 20 are transmitted to the base 16 through the elastomeric pads 62. In many embodiments the resulting pad loading will be great enough to prevent any relative motion at the contact surfaces between each pad 62 and the liner 64 and retainer cap 72 in the course of tower sway. Where frictional resistance is not sufficient to prevent sliding, the retainer ribs 68 and upper retainer cap 72 serve to mechanically restrain relative motion. Thus, the articulated joint 18 contains no sliding bearing surfaces to wear. Rotation of the lower tower shell 46 relative to the tower support shell 44 of the base 16 occuring in the course of tower sway is fully accommodated by shearing action in the pads 62.

Figure 6:
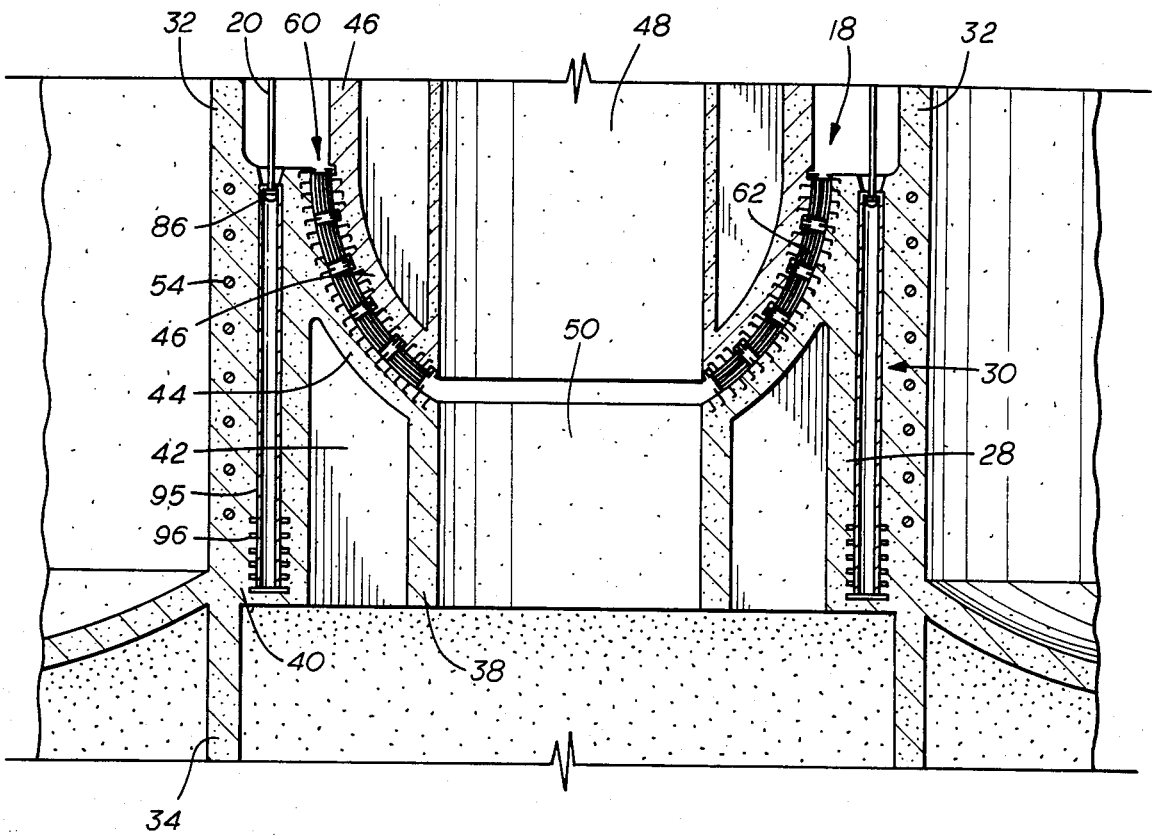
FIG. 6 is a detail, corresponding to FIG. 2, of the joint housing.

Design criteria for the elastomeric pads 62 are largely controlled by the size of the joint 18, the loading transferred across the joint 18 and the maximum tower inclination. In a preferred embodiment, the radius of the lower tower shell 46 is 14.5 meters and the maximum inclination of the tower 14 is 2°. The resulting motion (termed "kick back") of the outer surface of the lower tower shell 46 relative to the tower support shell 44 at maximum inclination is about 51 cm. This kick back results in total shear deformation of about 51 cm in each of the elastomeric pads 62. It is desirable to limit the shear strain of the pads 62 to no more than about 100%, which is well within the elastic limit of the pads 62. Accordingly, the pads 62 should be 50–60 cm in thickness. The pads 62 are made of alternating sheets of natural rubber and steel laminated together. In the preferred embodiment, each rubber sheet is about 4 cm thick and each steel sheet is about 0.5 cm thick. By dividing each pad 62 into a number of relatively thin sheets of elastomeric material, the shape factor (that is, the ratio of loaded surface area to unloaded surface area) is maintained very high, increasing the maximum allowable shear and normal loading for each pad. The side-to-side dimension of each of the hexagonal elastomeric pads 62 should be about 2 meters. With pads this size, an elastomeric joint 18 such as that shown in FIG. 6, having a radius of 14.5 meters, would require a total of about 250 pads 62 for full coverage of the joint surface.

The design of the articulated joint 18 yields a straightforward construction, avoiding the need to specify close tolerances. Construction of the articulated joint 18 commences upon completion of the ringwalls 38, 40 and radial diaphragms 42 of the base 16. Formwork is placed along the upper surface of the ringwalls 38, 40 and radial diaphragms 42 to define the lower surface of the tower support shell 44. Reinforcing steel is then secured above the formwork. The joint liner 64 is fabricated in a plurality of sections which are set in place atop the reinforcing steel and then welded together to form an integral whole. Concrete is then pumped through access holes (not shown) in the joint liner 64 to form the tower support shell 44, defined at its lower boundary by the forms and its upper boundary by the joint liner 64. Alternately, the tower support shell 44 can be fabricated using cast-in-place concrete construction, with the joint liner 64 being installed after completion of concrete casting. In this embodiment, grout would be injected between the tower support shell 44 and joint liner 64 to provide bonding and support for the joint liner 64.

Figure 7:
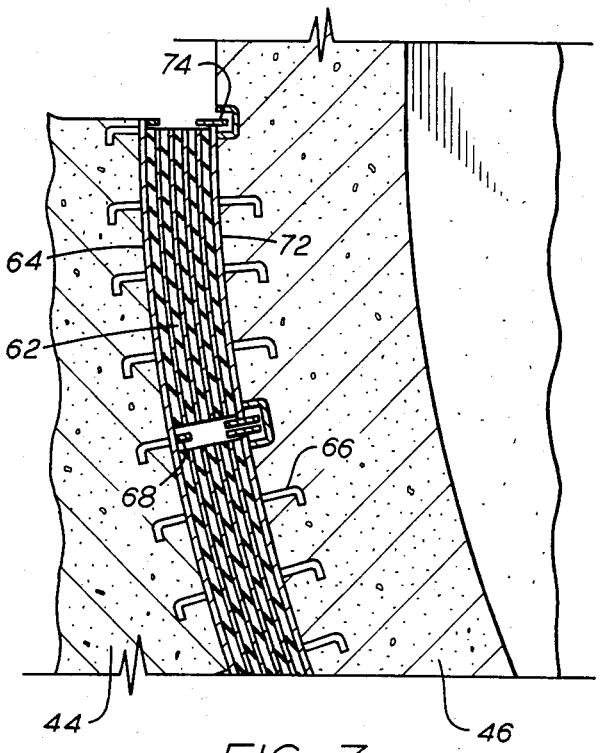
FIG. 7 is a detail, corresponding to FIG. 6, of the articulated joint.

Following completion of the joint liner 64, an elastomeric pad 62 is placed in each of the hexagonal pockets 70 defined by the pad retainer ribs 68. As previously detailed, there is no need to secure the pads 62 to the joint liner 64. The upper retainer caps 72 are then placed on each of the pads 62. The retainer caps 72 have ribs 74 projecting upward and downward from their pad support surfaces, as shown in FIGS. 7 and 8. Once the caps 72 are in place, a channel piece 76 is placed over each adjacent pair of upward ribs 74 at the interface between adjacent retainer caps 72. The concrete for the lower tower shell 46 is then poured directly atop the retainer caps 72, the retainer caps 73 defining the outer surface of the lower tower shell 46. The channel pieces 76 prevent concrete from entering the space between the joint liner 64 and the retainer caps 72.

Dimensional tolerances on every aspect of the elastomeric joint 18 are easily met. The elastomeric pads 62 are fabricated to have a side-to-side dimension about 1 to 2 cm less than the mean side-to-side dimension of the hexagonal pockets 70 and 0.5 to 1 cm less than the side-to-side dimension of the retainer caps 72. Because the lower tower shell 46 is cast directly atop the retainer caps 72, the thickness of the pads 62 can vary up to several centimeters from pad to pad with no affect on the joint 18. Additionally, due to the use of elastomeric pads 62 intermediate the tower support shell 44 and lower tower shell 46, slight irregularities in the sphericity of the shells 44, 46 do not pose a problem as the individual elastomeric pads 62 can be shimmed and directed to a common focus. It is important that the profiles of the shells 44,46 match closely. However, this is achieved automatically since the pad retainer caps 72 are used as the lower formwork for casting the lower tower shell 46.

Because the surface area of the joint is so great (about 1120 square meters in the preferred embodiment) relative to the load it bears, the compressional stress applied to each pad 62 is relatively low. In the preferred embodiment the maximum stress to which any of the pads 62 is subjected is about 7 MPa, assuming a full compliment of pads 62. This is considerably less than the maximum allowable safe compressional stress for the laminated elastomeric pads 62. Accordingly, the joint 18 can operate with a significant number of the pads 62 absent or non-functional. The joint design ensures that in the event of failure (e.g. delamination) of any or all of the pads 62, there will not be a substantial loss or redistribution of joint material, movement of the tower 14 in the joint housing 30 or immediate damage to the tower 14. Thus, the joint 18 is substantially fail-safe.

As best shown in FIG. 1, the tower 14 is a substantially rigid concrete shell structure formed of upper and lower tower sections 78, 80 rigidly framed together at a ring beam 82, which serves as the tower tension member anchorage 24. It is anticipated that the interior of the tower 14 will be flooded following installation of the structure 10. In the preferred embodiment of the present invention, the tower 14 and deck 12 together have a net negative buoyancy. Though buoyancy is not necessary to the stabilization of the structure 10, in some embodiments it may be desirable to provide supplemental buoyancy near the upper portion of the tower 14 for the purpose of offsetting some portion of the deckload or tuning the fundamental period of the structure 10.

The tension members 20, preferably cables, are each anchored at one end to the ring beam 82 and at the other end to the base tension member anchorage 22. The cables 20 are adjusted in the course of fabricating the structure 10 to have a preselected tension. As previously detailed, the tensioned cables 20 serve to provide the stabilization necessary to the structure 10. The magnitude of the cable pretension is preferably great enough to prevent the cables 20 from going slack at maximum tower inclination. This avoids snap loading of the cables 20 and tower 14 as the tower 14 returns to a vertical orientation. The use of pretensioned cables also provides torsional resistance to the tower 14 and renders the tower 14 more resistant to sway than would be the case were the cables not under tension when the tower 14 is vertical. Additionally, the use of pretensioned cables maintains the lower tower section 80 in compression at all times. This imposes the compressive preload necessary in concrete structures, thereby minimizing the amount of conventional bonded prestressed steel required in the lower tower section 80. The upper tower section 78, which is not under the compressive loading of the cables 20, is prestressed with conventional bonded prestressing steel.

Figure 9:
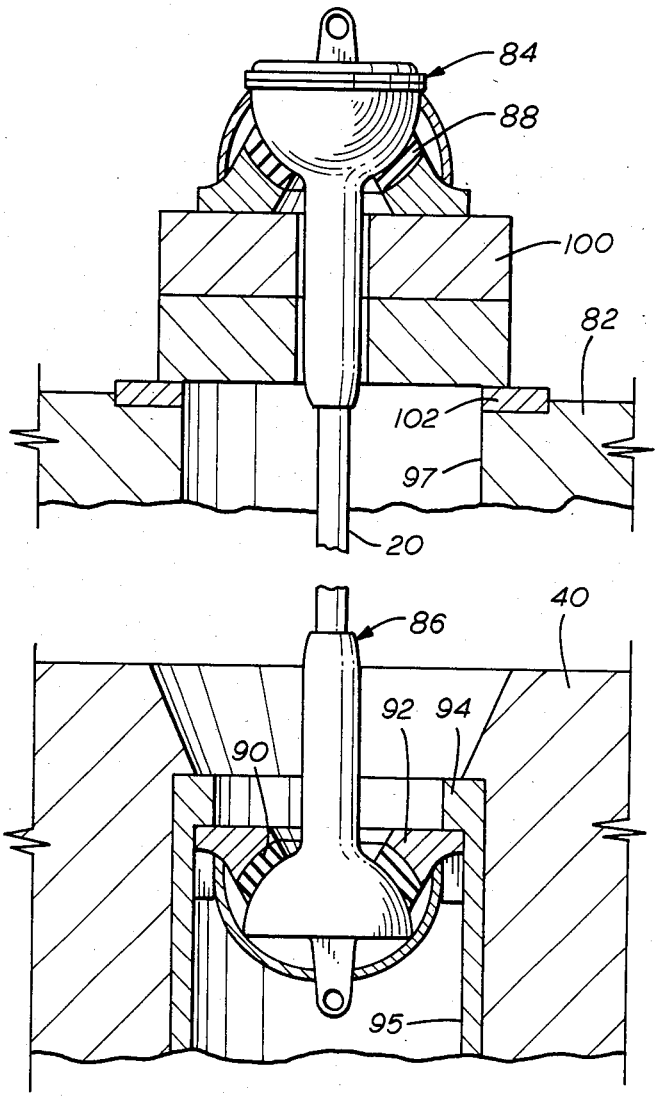
FIG. 9 is an elevational view of one of the stabilizing cables illustrating its attachment to the tower and base anchorages.
Figure 10:
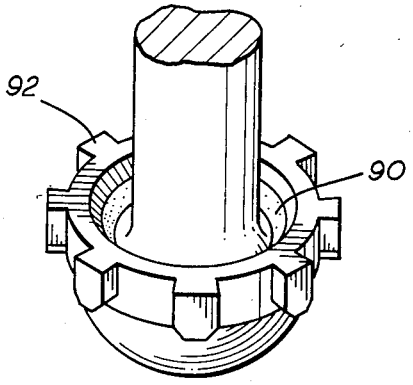
FIG. 10 is an isometric view of the shear connector of the lower cable termination.

As best shown in FIGS. 9 and 10, each cable 20 is provided with upper and lower cable terminations 84, 86. The cable terminations 84, 86 preferably take the form of hemispherical poured sockets having elastomeric load bearings 88, 90. The use of elastomeric bearings accommodates rotation of the cables 20 as the tower 14 sways, substantially eliminating secondary bending stresses in the cables 20. Alternately, the elimination of secondary bending stresses could be accomplished by using shaped cable terminations (not shown) in which the cables bend over a controlled length instead of at a discrete pivot.

The lower cable termination 86 is provided with a shear connector 92 which mates with and locks into a shear connector landing 94. The shear connector landing 94 is secured within a corresponding cable anchorage embedment 95, shown in FIG. 6, situated in the outer housing ringwall 40 of the joint housing 30. As shown in FIG. 5, the cable anchorage embedments 95 define a circular array concentric with and interior to the circumferential prestressing members 54. The cable anchorage embedments 95 are smooth tubular members extending downward to a position proximate the bottom of the joint housing 30. Each of the embedments 95 has shear lugs 96 near its lower end so that the load carried by the cables 20 is transferred to the base 16 proximate the bottom of the outer housing ringwall 40. The upper termination 84 of each cable 20 extends upward through an aperture 97 in the ring beam 82. The upper cable termination 84 rests on split shims 100 seated atop a ring beam bearing plate 102 positioned surrounding the upper end of each ring beam aperture 97.

In installation of a cable 20, the cable 20 is lowered through the ring beam aperture 97 and the lower cable termination shear connector 92 is guided into the shear connector landing 94. The cable 20 is then rotated and pulled upward to lock the shear connector 92 into the shear connector landing 94. Once the cable 20 is anchored to the base 16 the upper cable termination 84 is pulled upward by a stressing ram (not shown) until the cable 20 reaches the desired level of tension. Split shims 100 are then placed between the upper cable termination 84 and the bearing plate 102 to maintain the cable 20 at this tension level. The cables 20 are installed and tensioned prior to offshore installation of the structure 10. During operation of the structure 10 the cables 20 can be individually removed for inspection and replacement as necessary.

Fabrication of the structure 10 is straightforward, largely following procedures well known to those skilled in the art of concrete shell construction for offshore structures. The skirts 34, caisson cells 32, joint housing 30, elastomeric joint 18, and lower tower shell 46 are constructed in a conventional graving dock. The lower tower section 80 and ring beam 82 are slipformed and the cables 20 are installed in the dry with the structure floating on the cassion cells 32. The structure 10 is then ballasted down for subsequent slipforming of the upper tower section 78. The design of the articulated joint 18 minimizes the need for close tolerances in fabrication of the joint 18, as detailed previously. After completion of the joint housing 30, the tower 14 is slipformed in a conventional manner. The lower tower section 80 is stabilized temporarily by steel columns (not shown) embeded in the outer housing ringwall 40 and welded to embedments cast in the lower tower section 80. After completion of the lower tower section 80 and ring beam 82 but prior to fabrication of the upper tower section 78, the cables 20 should be installed and tensioned to the desired level. At this point the temporary steel stabilizing columns can be removed. Installation of the structure 10 is greatly facilitated by the fact that the cables 20, which provide substantially all stabilization required by the structure 10, are installed and fully operational prior to towing and installation. Thus, at the time the structure 10 is installed offshore, it is fully stabilized.

Figure 11:
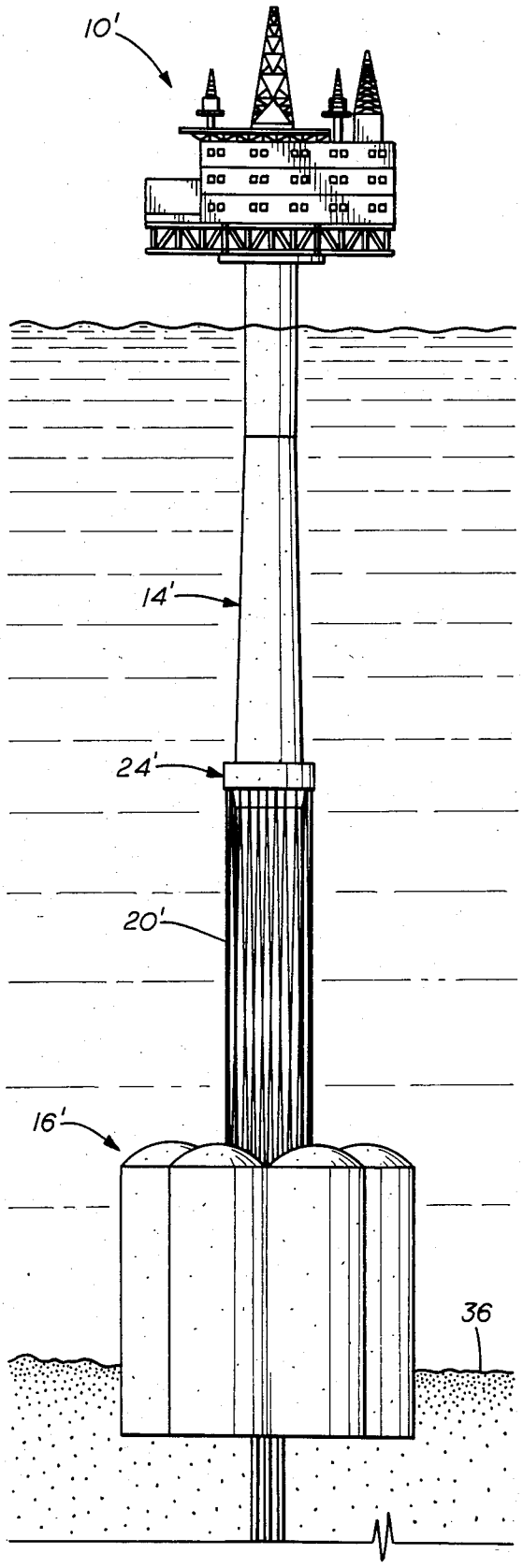
FIG. 11 shows an elevational view of an embodiment of the present invention using helically wound prestressed cables.

In some applications it may be desirable to provide the structure 10' with increased resistance to sway and torque. This may be accomplished by arranging the cables 20' in a helically wound, torque-balanced array, as shown in FIG. 11. In this embodiment it is necessary to provide two sets of cables having opposite helical orientations. The two sets are preferably anchored in two concentric circular arrays at the base and tower anchorages 22',24'. One set of cables 20' having a first helical orientation extends from an outer anchoring circle at the base anchorage 22' to an inner anchoring circle at the tower anchorage 24'. The other set of cables 20' has the reverse helical orientation and extends from the inner anchoring circle at the base anchorage 22' to the outer anchoring circle at the tower anchorage 24'.

Figure 12:
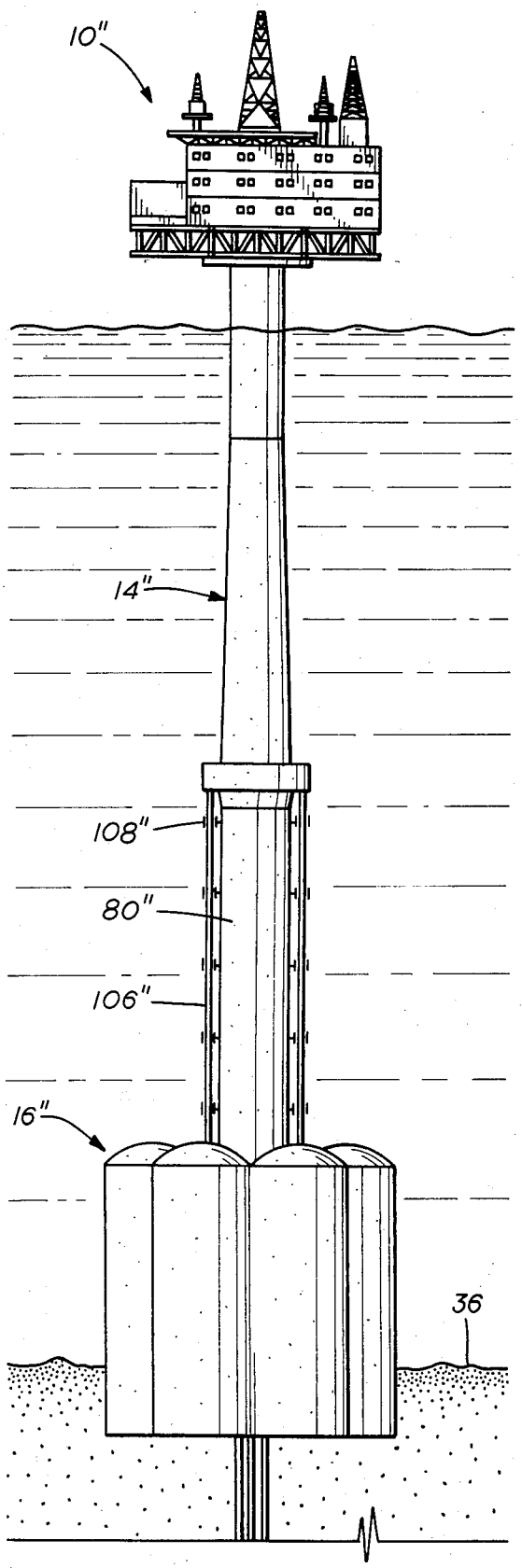
FIG. 12 shows an elevational view of an embodiment of the present invention in which the stabilizing members are tubular steel elements rather than prestressed cables.

In another alternate embodiment of the present invention, illustrated in FIG. 12, tubular steel members 106" are used in place of cables as the stabilizing members for the structure 10". Unlike cables, the tubular members 106" can act both in tension and compression to establish the requisite restoring force in response to tower sway. Lateral guides 108" extending outward from the lower tower section 80" support the tubular steel members 106" against buckling when they are placed in compression. Torsional loads are transferred from the tower to the tubular members 106" through the lowest of the lateral guides 108" for each tubular member 106". It is relatively unlikely that it would be necessary to replace the tubular members 106". Accordingly, they may be rigidly embedded in the outer housing ringwall 40" and ring beam 82".

In yet another embodiment of the present invention, not shown, a plurality of towers extends upward from a common base to support a deck above the ocean surface. In such an embodiment, each tower is preferably provided with its own set of stabilizing members.

The preferred embodiment of the present invention and the preferred methods of using it have been detailed above. It should be understood that the foregoing description is illustrative, and that other embodiments of the invention can be employed without departing from the full scope of the invention as set forth in the appended claims.

What is claimed is:

1. A compliant offshore structure, comprising:

a base adapted to be supported on the ocean floor;

a substantially vertical tower extending upward from said base to a position proximate the ocean surface, the longitudinal axis of said tower defining the central axis of said structure;

a joint establishing the interface between said tower and said base, said joint being articulated to permit said tower to pivot about said base; and a plurality of elongate stabilizing members each having a first end secured to said base at a spaced lateral distance from said central axis and a second end secured to said tower at a stabilizing member anchorage located a spaced distance above said articulated joint, said stabilizing members being installed in a pretensioned condition, said stabilizing members being arranged in an array surrounding said central axis whereby at least some of said stabilizing members undergo elongation in response to pivoting of said tower about said base.

2. The compliant offshore structure as set forth in claim 1 wherein said elongate stabilizing member are cables, said cables being stressed to a preselected tension.

3. The compliant offshore structure as set forth in claim 1 wherein said base includes a caisson establishing a gravity-type foundation for said structure.

4. The compliant offshore structure as set forth in claim 1 wherein said base and tower are concrete shell structures, said base establishing a gravity-type foundation for said structure, said elongate stabilizing members being maintained in tension to establish a compressive loading on said tower intermediate said base and said stabilizing member anchorage.

5. The compliant offshore structure as set forth in claim 4 wherein said stabilizing member anchorage is situated at an elevation on the tower below the ocean surface.

6. The compliant offshore structure as set forth in claim 1 wherein said stabilizing member anchorage is situated at an elevation on the tower below the ocean surface.

7. The compliant offshore structure as set forth in claim 1 wherein said tower has a net negative buoyancy.

8. The compliant offshore structure as set forth in claim 1 wherein said stabilizing member anchorage is a ring beam concentric with and secured to said tower.

9. A compliant offshore structure, comprising:

a base adapted to be supported on the ocean floor;

a substantially vertical tower extending upward from said base to a position proximate the ocean surface;

a deck supported on said tower, said deck and tower together having a net negative buoyancy in normal operation of said structure;

a joint establishing the interface between said tower and said base, said joint being articulated to permit said tower to pivot about said base;

a cable anchorage secured to said tower at a spaced distance above said articulated joint;

a cable anchorage on said base; and, a plurality of cables each having a first end secured to said base cable anchorage and a second end secured to said tower cable anchorage, said cables being tensioned and being arranged in an array surrounding the longitudinal axis of said tower.

10. The compliant offshore structure as set forth in claim 9 wherein said tower cable anchorage is situated below the ocean surface.

11. The compliant offshore structure as set forth in claim 9 wherein said tower is a concrete shell structure and wherein said base is a concrete caisson.

12. The compliant offshore structure as set forth in claim 9 wherein said gravity base defines a concave joint housing and said tower includes a curved bottom portion adapted to be matingly received within said joint housing, there being an elastomeric hinge interposed between said joint housing and said curved tower bottom portion.

13. The compliant offshore structure as set forth in claim 12 wherein said elastomeric hinge includes a plurality of elastomeric pads each having a lower surface resting upon said joint housing and having an upper surface supporting said convex tower bottom.

14. The compliant offshore structure as set forth in claim 13 wherein said joint housing and said lower tower portion define bearing surfaces having substantially constant radii of curvature, with the central portion of each bearing surface being removed to define a recess permitting vertical access through said articulated joint.

15. The compliant offshore structure as set forth in claim 9 wherein said base and tower are metal space frame structures, said base being secured to the ocean floor by piles.

16. The compliant offshore structure as set forth in claim 15 wherein said joint is a flex bay.

17. A compliant, concrete gravity structure adapted for use in offshore oil and gas drilling and producing operations, comprising:

a concrete base adapted to establish a gravity-type foundation on the ocean floor;

a substantially vertical tower made of concrete construction, said tower extending upward from said base to a position proximate said ocean surface, the longitudinal axis of said tower defining the central axis of said structure;

a joint supporting said tower on said base, said joint being articulated to permit said tower to pivot about said base;

a deck supported atop said tower, said deck and tower together having a net negative buoyancy during normal operation of said structure; and a plurality of elongate elements each having a first end secured to said base at a base anchorage and a second end secured to said tower at a tower anchorage, said base anchorage being laterally spaced on said base from said tower longitudinal axis, said elongate elements being maintained in tension whereby said tower is maintained in compression intermediate said base and said tower anchorage and whereby pivoting of said tower away from the vertical increases the tension in at least some of said elongate elements, this establishing a moment tending to restore said tower to a vertical position.

18. The compliant offshore gravity structure as set forth in claim 17, wherein said tower and base have mating surfaces defining said joint, said joint including elastomeric material interposed between said mating surfaces.

19. The compliant offshore gravity structure as set forth in claim 17, wherein said elongate elements are cables removably secured to said base and tower anchorages.

20. The compliant offshore gravity structure as set forth in claim 17, wherein said elongate elements are situated exterior to said tower.

21. The compliant offshore gravity structure as set forth in claim 20, wherein said tower anchorage is situated beneath the ocean surface.

22. The compliant offshore gravity structure as set forth in claim 20, wherein said tower and said joint define a vertically extending recess centered about said central axis of said structure, said structure including drilling conductors extending through said recess.

23. The compliant offshore gravity structure as set forth in claim 17, wherein said structure includes a plurality of towers extending upward from said base.

24. A method for constructing a concrete offshore gravity structure adapted to have a compliant response to environmental forces, said method comprising the steps of:

fabricating a base portion adapted to establish a gravity-type foundation for said structure on the ocean bottom;

commencing fabrication of a tower portion of said structure, said tower being adapted to support a deck above the ocean surface, the interface between said tower and base defining an articulated joint adapted to permit said tower to rotate about said base;

continuing fabrication of said tower until said tower has reached a preselected height above said base;

attaching a plurality of elongate stabilizing members in tension to said structure, each of said stabilizing members have a first end secured to said base and a second end secured to said tower at a position proximate said preselected elevation above said base, said stabilizing members being arranged in an array surrounding said tower, said stabilizing members being adapted upon installation to stabilize the partially completed tower against excessive sway;

completing fabrication of said tower after attachment of said stabilizing members;

establishing a deck atop said tower, said deck and tower adapted to have a net negative buoyancy in normal operation of said tower; and towing said structure to the site at which it is to be installed.

25. The method as set forth in claim 24 wherein said stabilizing members are cables, said method further including the step of tensioning said cables to a preselected level prior to completion of said tower.

26. The method as set forth in claim 25 further including the step of securing temporary elongate stabilizing members to said structure before fabrication of said tower has reached said preselected elevation, said temporary elongate stabilizing members each having a first end secured to said base and a second end secured to said tower at an elevation below said preselected elevation.

27. The method as set forth in claim 26 further including the step of removing said temporary elongate stabilizing members prior to installation of said structure.

28. A compliant offshore structure, comprising:

a base portion adapted to be fixedly secured to the ocean bottom, said base portion defining a lower joint surface;

a tower extending upward from said base portion along a substantially vertical axis to a position above the ocean surface, said tower defining a vertically extending central recess along said vertical axis, said tower further defining an upper joint surface at its lower end, said upper joint surface being configured to mate with said lower joint surface;

a plurality of elastomeric pads interposed between said lower and upper joint surfaces, said elastomeric pads and said lower and upper joint surfaces defining a joint adapted to permit said tower to pivot about said base, said joint defining a recess therethrough centered on said vertical axis, whereby drilling conductors may extend downward through said tower and said joint into the ocean bottom; and means for stabilizing said tower against excessive pivoting about said joint.

29. The compliant offshore structure as set forth in claim 28 wherein said stabilizing means includes a plurality of elongate stabilizing elements each having a first end secured to said base at a spaced lateral distance from said central axis and a second end secured to said tower at a stabilizing member anchorage located a spaced distance above said joint, said stabilizing members being arranged in an array surrounding said central axis whereby at least some of said stabilizing members undergo elongation in response to pivoting of said tower about said base.

30. A compliant, concrete gravity structure adapted for use in offshore oil and gas drilling and producing operations, comprising:

a concrete base on the ocean floor;

a substantially vertical tower of concrete construction, said tower extending upward from said base to a position proximate said ocean surface, the longitudinal axis of said tower defining the central axis of said structure, said tower defining a vertically extending recess extending along said central axis, said vertically extending recess being adapted to receive drilling conductors;

a deck supported atop said tower, said deck and tower together having a net negative buoyancy during normal operation of said structure;

a joint supporting said tower on said base, said joint being articulated to permit said tower to pivot about said base, said joint and said base defining a central recess in vertical alignment with said vertically extending recess of said tower whereby drilling conductors may be positioned along the central axis of the structure from the ocean floor to said deck; and a plurality of elongate elements each having a first end secured to said base at a base anchorage and a second end secured to said tower at a tower anchorage, said base anchorage being laterally spaced on said base from said structure central axis, said elongate elements being maintained in tension whereby said tower is maintained in compression intermediate said base and said tower anchorage and whereby pivoting of said tower away from the vertical increases the tension in at least some of said elongate elements, this establishing a moment tending to restore said tower to a vertical orientation.

* * * * *